US005400409A

United States Patent [19]

Linhard

[11] Patent Number: 5,400,409

[45] Date of Patent: Mar. 21, 1995

[54] NOISE-REDUCTION METHOD FOR NOISE-AFFECTED VOICE CHANNELS

[75] Inventor: Klaus Linhard, Neu-Ulm, Germany

[73] Assignee: Daimler-Benz AG, Stuttgart, Germany

[21] Appl. No.: 208,747

[22] Filed: Mar. 11, 1994

Related U.S. Application Data

[63] Continuation-in-part of Ser. No. 171,472, Dec. 23, 1993.

[30] Foreign Application Priority Data

Dec. 23, 1992 [DE] Germany ..... 42 43 831.4
Mar. 11, 1993 [DE] Germany ..... 43 07 688.2

[51] Int. Cl.[6] ..... H04R 3/00
[52] U.S. Cl. ..... 381/92; 381/94; 381/47
[58] Field of Search ..... 381/92, 94, 47; 379/420, 58, 59; 455/304

[56] References Cited

U.S. PATENT DOCUMENTS 4,066,842 1/1978 Allen .
4,420,655 12/1983 Suzuki .
4,653,102 3/1987 Hansen ..... 381/92
4,802,227 1/1989 Elko et al. ..... 381/92
4,932,063 1/1990 Nakamura .
5,208,864 5/1993 Kaneda ..... 381/47

FOREIGN PATENT DOCUMENTS

4012349A1 10/1990 Germany .
4015381A1 4/1991 Germany .
4029697A1 4/1991 Germany .
4106405A1 9/1991 Germany .
3837066C2 1/1992 Germany .
WO89/03141 4/1989 WIPO .

*Primary Examiner*—Curtis Kuntz
*Assistant Examiner*—Mark D. Kelly
*Attorney, Agent, or Firm*—Spencer, Frank & Schneider

[57] ABSTRACT

A method that can be used not only for elimination of noise, for example in automatic speech recognition, but also to improve the voice quality for people, for instance during use of the speaker function of a car phone. The noise reduction is executed with two or multiple channels in such a manner that the temporal and architectural acoustical signal properties of speech and interference are utilized step-by-step and systematically. According to the method a pivotable, acoustic directional lobe is produced for the individual voice channels by respective digital directional filters and a linear phase estimation to correct for a phase difference between the two channels. The noise in the individual voice channels is estimated during speaking pauses, and the temporally stationary noise sources are damped by means of spectral subtraction. The individual voice channels are subsequently added whereby the statistical disturbances of spectral subtraction are averaged. Finally, the composite signal resulting from the addition is subsequently processed with a modified coherence function to damp diffuse noise and echo components.

4 Claims, 2 Drawing Sheets

MICRO-PHONE PICKUPS
10
11
x
y
12
13
$x_\ell(i)$
$y_\ell(i)$
FREQUENCY DOMAIN TRANS-FORMATION
FREQUENCY DOMAIN TRANS-FORMATION
14
15
$H_{SPS1}$
$H_{SPS2}$
SPECTRAL SUBTRACTION
SPECTRAL SUBTRACTION
16
$H_{ALLP}$
PHASE SHIFT CORRECTION
18
19
$H_{R1}$
$H_{R2}$
DIRECTIONAL FILTER
DIRECTIONAL FILTER
20
$z_\ell(i)$
+
21
$H_{KKF}$
CROSS POWER DENSITY
22
$H_{INV}$
INVERSE FILTER
z

NOISE-REDUCTION METHOD FOR NOISE-AFFECTED VOICE CHANNELS

CROSS REFERENCE TO RELATED APPLICATIONS

This application is a continuation-in-part of co-pending United States patent application Ser. No. 08/171,472, filed Dec. 23, 1993, the subject matter of which is incorporated by reference.

This application claims the priority of German Patent Applications P 42 43 831.4, filed Dec. 23, 1992 and P 43 07 688.2, filed Mar. 11, 1993, the subject matter of both of which is incorporated herein by reference.

BACKGROUND OF THE INVENTION

The invention relates to a method for reducing the noise of at least two noise-affected voice channels, wherein the noise-affected voice channels are combined to create one output channel.

A method of this type is used in automatic speech recognition or in speaker phone systems to improve voice quality, for example in offices or motor vehicles.

Noise-affected speech is more easily recognizable when it is registered with two or more voice channels. Speech and noise are present in each channel. The multi-channel signals are processed with digital signal processing.

In multi-channel systems the transit time difference of the useful signal must first be determined in the individual channels. It is then possible later to recombine the individual channels in-phase into one channel.

Systems having two channels are of particular interest, because in this instance a spatial sound field can be resolved in individual directions with tolerable computing expenditure.

If it is known from which direction the relevant noise event originates, an acoustic directional lobe can be set to this event.

Noise reduction is first executed in each individual channel. Because noise reduction cannot take place error-free, distortions and artificial insertions (e.g. "musical tones") can occur. When the individually-processed channels are combined, an averaging is performed, and these errors are consequently reduced.

The composite signal is subsequently further processed with the use of cross-correlation of the signals in the individual channels. The prerequisite of this is that noises or echos are less correlated than the useful signal of the channels.

A method of combining two noise-affected voice channels is known from the publication "Multimicrophone signal-processing technique to remove room reverberation from speech signals" by Allen, Berkley and Blauert (J: Accoust. Soc. Am., Vol. 62, No. 4, October 1977) and "Noise Suppression Signal Processing Using 2-Point Received Signals" by Kaneda and Tohyame (Electronics and Communication in Japan, Vol. 67-A, No. 12, 1984). The first method is intended to remove reverberation from speech signals, and does not employ a true phase compensation; the removal of reverberation is only executed in a subsequent processing stage. The second method utilizes a simple, linear phase compensation of the channels. In this latter method, noise reduction also is executed only in the subsequent processing stage.

The object of the invention, therefore, is to provide a noise-reduction method in which noise reduction is executed in a plurality of stages and a significant improvement in speech quality is achieved.

SUMMARY OF THE INVENTION

The object is attained generally according to the present invention by a method for reducing the noise in an output signal of a common output voice channel created by combining at least first and second digital voice signals from related noise-affected respective first and second voice channels, with the method comprising the steps of estimating the noise in the individual at least first and second channels during speaking pauses in the respective at least first and second signals, and damping temporally stationary noise sources by spectral subtraction to provide respective adjusted at least first and second signals; producing a pivotable, acoustic directional lobe, which follows movement of a speaker producing the at least first and second voice signals and which damps spatial noise sources, for the respective first and second channels by respective digital directional filtering of the respective first and second adjusted signals and an adjustment, using a linear phase shift estimation, of a phase difference between the respective at least first and second signals to produce respective further adjusted at least first and second signals; adding the respective further adjusted at least first and second signals for the respective voice channels to average statistical disturbances resulting from the spectral subtractions and to provide a composite signal; and subsequently processing the composite signal with a modified coherence function to damp diffuse noise and echo components.

According to the preferred embodiments of the invention the spectral subtraction is performed with first and second adaptive smoothing constants $\alpha$ and $\beta$, and includes estimating the noise spectrum $S_{nn}$ with the second adaptive smoothing constant $\beta$, and determining the power density $S_{xx}$ of the respective at least first and second signals of the respective voice channels and greatly smoothing the respective power density $S_{xx}$ with the first adaptive smoothing constant $\alpha$ during speaking pauses, and slightly during speaking.

Preferably, the said linear phase shift of the at least first and second related signals is determined in the power domain by means of a specific number of maxima of the cross-power density, each of the at least first and second related signals is transformed into the frequency domain prior to the step of estimating, and at least the phase correction and the directional filtering are carried out in the frequency domain.

The spatial and temporal properties of the useful signal and the noise are systematically utilized in this method:

1) Spatial property of the sound fields:

a) Damping of point-like noise sources

An acoustic directional lobe, together with the phase estimation, is oriented toward the speaker with digital directional filters at the inlet of the channels. The method described in the above identified parent United States patent application Ser. No. 08/171,472 filed Dec. 23, 1993 is used for phase estimation. This method is effective with respect to noises and only requires a low computation expenditure. The directional filters are at a fixed setting. It is assumed that the speaker is relatively close to the microphones (distance $\leqq 1$ m) and only moves within a limited area. Non-stationary and stationary point-like noise sources are damped by means of this spatial evaluation.

b) Damping of diffuse noise sources

Diffuse noise and echo components are damped during subsequent processing with the aid of cross-correlation.

2) Temporal signal properties

Spectral subtraction is used to estimate the noise during speaking pauses and executes a substraction in the spectral range that corresponds to the magnitude. In this instance the temporally stationary noise components are damped.

3) Averaging the channels (addition):

Sometimes errors in spectral substraction (distortion and "musical tones") coincidentally occur temporally in the individual channels because of the spatial separation of the receiving channels (microphones at a specific spacing). Averaging the channels reduces these errors.

The invention is described in greater detail below with reference to embodiments thereof and schematic drawings.

DETAILED DESCRIPTION OF THE PREFERRED EMBODIMENTS

Figure 1:
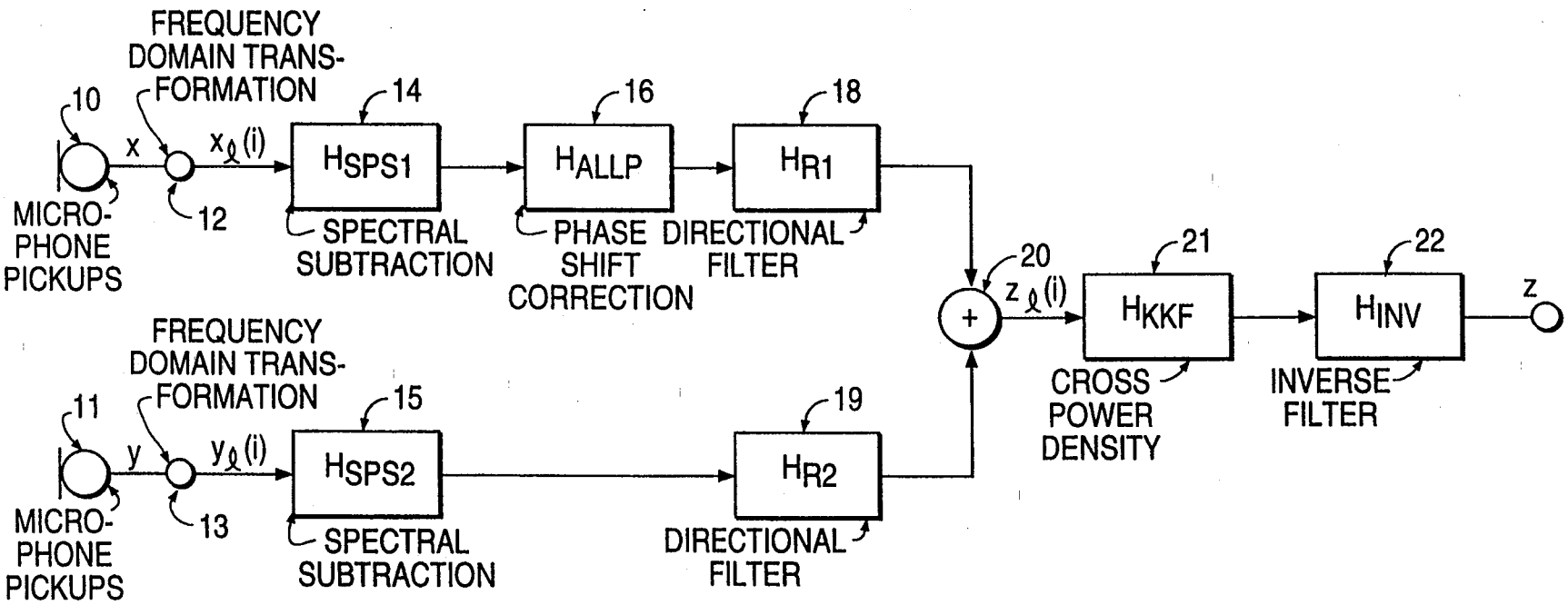
FIG. 1 shows a block diagram illustrating the entire method according to the invention.
Figure 2:
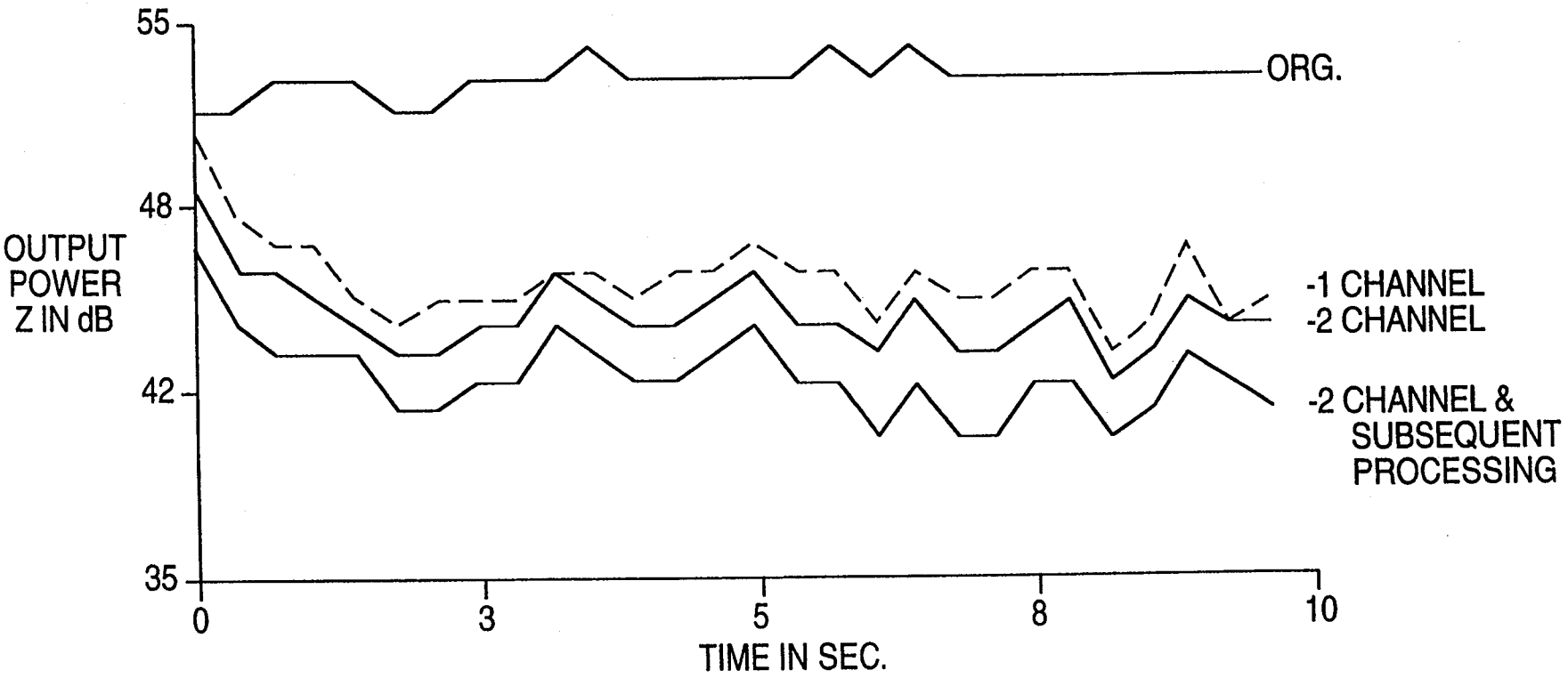
FIG. 2 shows a comparison of the averaged output powers Z of different methods with the power of the original noise signal (example: distance from microphone is 12 cm in a vehicle traveling at 140 km/h). As shown increasing noise reduction results when processing is executed with one channel, with two channels, and with two channels with subsequent processing according to the invention.

Referring now to FIG. 1, signals x and y from microphones 10 and 11, respectively, are transformed into the frequency domain, (FFT, fast Fourier transformation) at 12 and 13, respectively. The transferred segments are half-overlapped and weighted with a Hanning window. The segments are each N values long and are extended by an additional N zeros. The transformation length is selected at, for example, 2N=512. Transformed segments $X_l(i)$ and $Y_l(i)$ thus result. Output signal z results after inverse transformation and overlapping of the segments. The block index of the segments is indicated by l, and i indicates the discrete frequency (i=0, 1, 2 . . . , 2N−1). The sampling rate of signals x and y is, for example, 12 kHz.

In the frequency domain the long-time average value of the magnitude spectrum for each channel is subtracted using spectral subtraction $H_{SPS}$ at 14 and 15, respectively, from the respective frequency domain signal $X_l(i)$ or $Y_l(i)$. During the spectral subtraction, the short-time average K and the long-time average L are determined and used to calculate a first adaptive smoothing constant $\beta$, which is used to estimate the noise spectrum $S_{nn}(i)$. This adaptive smoothing constant replaces the otherwise standard speaking pause detector. The block index is indicated by l, and i indicates the discrete frequency. An example of smoothing constant $\beta_o$ is $\beta_o=0.03$.

In particular, the short-time average is determined according to the relationship $$K_l = \frac{1}{2N}\sum_{i=0}^{2N-1} |X_l(i)|^2 \quad (1)$$

where $\beta_1 = g_1\beta_o$, and (2)

with $g_l = \frac{2L_{l-1}}{L_{l-1}+K_l}$, (3)

the long time average is $$L_l=(1-\beta_l)L_{l-1}+\beta_l K_l \quad (4)$$

and the estimated noise spectrum is $$\hat{S}_{nn,l}(i)=(1-\beta_l)\hat{S}_{nn,l-1}(i)+\beta_l|X_l(i)|^2 \quad (5)$$

The noise spectrum is normalized and subtracted.

$$|\hat{X}_l(i)| = |X_l(i)| - \frac{\hat{S}_{nn,l}(i)}{|X_l(i)|} \quad (6)$$

$$\hat{X}_l(i) = \left[1 - \frac{\hat{S}_{nn,l}(i)}{|X_l(i)|^2}\right]X_l(i) \quad (7)$$

A modified form results wherein:

$$\text{for}\left[1 - \alpha\sqrt{\frac{\hat{S}_{nn,l}(i)}{S_{xx,l}(i)}}\right]X_l(i) < f_o S_{nn,l}(i);\ \text{and} \quad (8)$$

$$\hat{X}_l(i) = \left[1 - \alpha\sqrt{\frac{\hat{S}_{nn,l}(I)}{S_{xx,l}(i)}}\right]X_l(i);$$

$$\text{otherwise: } \hat{X}_l(i) = f_o S_{nn,l}(i) \quad (9)$$

The following applies for power density $S_{xx,l}$ of a respective channel:

$$S_{xx,l}(i) = (1-\alpha_l)S_{xx,l-1}(i) + \alpha_l|X_l(i)|^2 \quad (10)$$

where: for $0.5 < 2 - g_l < 2.0$, (11)

$\alpha_l = 2 - g_l$; for $0.5 > 2 - g_l$, (12)

$\alpha_l = 0.5$; and for $2 < 2 - g_l$, (13)

$\alpha_l = 2$;

The variable $f_o$ is designated as a "spectral floor." A portion of the background noise is permitted in order to create a natural audial impression and mask part of the "musical tones." The variable $\alpha$ is an overestimation factor for the noise, and further reduces residual noise. For these values, $f_o=0.2$ and $\alpha=1.5$ can be selected, for example.

In contrast to the known forms of spectral subtraction, a second adaptive smoothing with $\alpha$ is additionally used to reduce a further component of the "musical tones," in that the power density $S_{xx}$ is smoothed slightly during speech and greatly during pauses.

Corresponding equations apply for the second channel Y.

The method disclosed in the above mentioned U.S. patent application Ser. No. 08/171,472 is used preferably to calculate the linear phase shift between useful components in the channels. This method is incorporated easily into the noise-reduction method of the invention. The phase shift is estimated for a selected number of cross power maxima, and the phase correction is achieved through multiplication in the frequency domain with the all-pass function $H_{allp}$ as indicated at 16 in FIG. 1.

$$X_l(i) = X_l(i)H_{ALLP,l} \quad (14)$$
$$X_l(i) = \hat{X}_l(i)(\cos(i^*\phi) + j\sin(i^*\phi)) \quad (15)$$

If more than two channels are provided, the phase correction is executed for the respective additional channel. The first channel serves as a reference.

Thereafter, the estimated signals $\hat{X}_l(i)$ and $\hat{Y}_l(i)$ are fed to the respective directional filters 18 and 19 for the channels, which filters are calculated with a "beam-forming method." In this method different events can be considered noise. Different directional filters $H_R$ result, corresponding to the noise situation. An aggregate of these filters is selected, but if the system status is known in later operation, one may switch to a specific aggregate, or the filters can be continuously adapted. Frost's gradient method ("An Algorithm for Linearly Constrained Adaptive Array Processing" Proc. IEEE, Vol. 60, No. 8, 1972) or Sondhi and Elko's method ("Adaptive Optimization of Microphone Arrays under a Nonlinear Constraint" Int. Conf. on ASSP, Tokyo, 1096, pp. 981–984) is used as a "beam-forming method."

The following multiplication for directional filtering results in the frequency domain:

$$\hat{X}_l(i)=\hat{X}_l(i)H_R(i). \quad (16)$$

With the directional filters 18 and 19, the addition at 20 of signals from the two channels at the output of filters 18 and 19 results in the total directional characteristic and the composite output signal $$Z_l(i)=\hat{X}_l(i)+\hat{Y}_l(i). \quad (17)$$

Furthermore, the addition of the channels leads to an averaging and subsequently a reduction in the statistical errors of the earlier spectral subtraction.

At 21, the cross-power density of the two channels is subsequently calculated with the aid of a further smoothing constant $\gamma$ (for example, $\gamma=0.3$), according to the equation $$S_{xy,l}(i)=(1-\gamma)S_{xy,l-1}(i)+\gamma\hat{X}_l(i)\hat{Y}_l(i), \quad (18)$$

and this cross-power density $S_{xy}$ is normalized with the sum of power densities $S_{xx}$, $S_{yy}$ of the individual channels, to produce a modified coherence function:

$$H_{KKF,l}(i) = \frac{S_{xy,l}(i)}{S_{xx,l}(i) + S_{yy,l}(i)}, \quad (19)$$

$$\text{for } \frac{S_{xy,l}(i)}{S_{xx,l}(i) + S_{yy,l}(i)} > 0.3; \text{ and} \quad (20)$$

$$\text{otherwise } H_{KKF,l}(i) = 0.3;$$

with $$S_{xx,l}(i)=(1-\gamma)S_{xx,l-1}(i)+\gamma\hat{X}_l(i)\hat{X}_l^*(i), \quad (21)$$

and $$S_{yy,l}(i)=(1-\gamma)S_{yy.,-1}(i)+\gamma\hat{Y}_l(i)\hat{Y}_l^*(i). \quad (22)$$

The following applies for output signal Z:

$$Z_l(i)=Z_l(i)H_{KKF,l}(i) \quad (23)$$

If directional filters 18 and 19 are used in accordance with the Sondhi and Elko method, an inverse filter 22 is necessary for frequency-response correction. This filter acts to boost lower frequencies, because the frequency response of the directional filters 18 and 19 (for the desired direction, toward the speaker) leads to a decrease in these frequencies. This filter 22 $H_{INV}$ can be approximated in a simple manner from the calculated frequency response.

$$Z_l(i)=Z_l(i)H_{INV,l}(i) \quad (24)$$

If the adaptation in the filters 18 and 19 is performed in accordance with the Frost method, no inverse filter 22 is necessary, because the frequency response has the constant value of 1 in the direction of the speaker.

The method of the invention is not limited to two-channel systems, but rather, can be applied to multi-channel (three and more channels) systems.

It will be understood that the above description of the present invention is susceptible to various modifications, changes and adaptations, and the same are intended to be comprehended within the meaning and range of equivalents of the appended claims.

I claim:

1. A method for reducing the noise in an output signal of a common output voice channel created by combining at least first and second digital voice signals from related noise-affected respective first and second voice channels, said method comprising the steps of:

estimating the noise in the individual at least first and second channels during speaking pauses in the respective at least first and second signals, and damping temporally stationary noise sources by spectral subtraction to provide respective adjusted at least first and second signals;

producing a pivotable, acoustic directional lobe, which follows movement of a speaker producing the at least first and second voice signals and which damps spatial noise sources, for the respective first and second channels by respective digital directional filtering of the respective said first and second adjusted signals and an adjustment of a phase difference between the respective at least first and second signals, using a linear phase shift estimation, to produce respective further adjusted at least first and second signals;

adding the respective said further adjusted at least first and second signals for the respective said voice channels to average statistical disturbances resulting from the spectral subtractions and to provide a composite signal; and subsequently processing the composite signal with a modified coherence function to damp diffuse noise and echo components.

2. A method as defined in claim 1, wherein said spectral subtraction is performed with first and second adaptive smoothing constants $\alpha$ and $\beta$, and includes:

estimating the noise spectrum $S_{nn}$ with the second adaptive smoothing constant $\beta$, and determining the power density $S_{xx}$ of the respective at least first and second signals of the respective voice channels and greatly smoothing the respective power density $S_{xx}$ with the first adaptive smoothing constant $\alpha$ during speaking pauses, and slightly during speaking.

3. A method as defined in claim 1, wherein said linear phase shift of said at least first and second related signals is determined in the power domain by means of a specific number of maxima of the cross-power density.

4. A method as defined in claim 1, further comprising: transforming each of the at least first and second related signals into the frequency domain prior to said step of estimating, and carrying out at least the phase correction and the directional filtering in the frequency domain.

* * * * *